United States Patent [19]

Cholet et al.

[11] 4,245,708

[45] Jan. 20, 1981

[54] BLADE STABILIZER PROVIDED WITH AT LEAST ONE FLUID PASSAGE HAVING A VENTURI EFFECT, IN PARTICULAR FOR USE IN COMBINATION WITH A DRILL BIT

[75] Inventors: Henri Cholet, Le Pecq; Jean Boulet, Paris, both of France

[73] Assignee: Institut Francais du Petrole, Rueil-Malmaison, France

[21] Appl. No.: 11,620

[22] Filed: Feb. 12, 1979

[30] Foreign Application Priority Data

Feb. 13, 1978 [FR] France ..... 78 04205

[51] Int. Cl.[3] ..... E21C 9/00

[52] U.S. Cl. ..... 175/325; 175/339; 308/4 A

[58] Field of Search ..... 175/325, 326, 344–347, 175/361–364, 324, 408, 339, 340; 166/241; 308/4 A; 17/325, 326

[56] References Cited

U.S. PATENT DOCUMENTS

| | | | |
|---|---|---|---|
| 2,247,564 | 7/1941 | Turner | 308/4 A |
| 3,320,004 | 5/1967 | Garrett | 308/4 A |
| 3,933,395 | 1/1976 | Evans | 308/4 A |

FOREIGN PATENT DOCUMENTS

| | | | |
|---|---|---|---|
| 2529380 | 1/1976 | Fed. Rep. of Germany | 175/340 |

*Primary Examiner*—James A. Leppink
*Assistant Examiner*—Richard E. Favreau
*Attorney, Agent, or Firm*—Millen & White

[57] ABSTRACT

A stabilizer for a tool, such as a rotary drill bit, comprises at least two blades spaced radially about the axis of the tool. Two adjacent blades define a venturi-shaped free angular space for a flow of drilling fluid. The width of each of the blades increases over at least a first portion, measured from the lower end of the blade, of the height of each blade. The height of the first portion is at least equal to one half of the width of the lower end of the free angular space.

14 Claims, 10 Drawing Figures

FIG.2
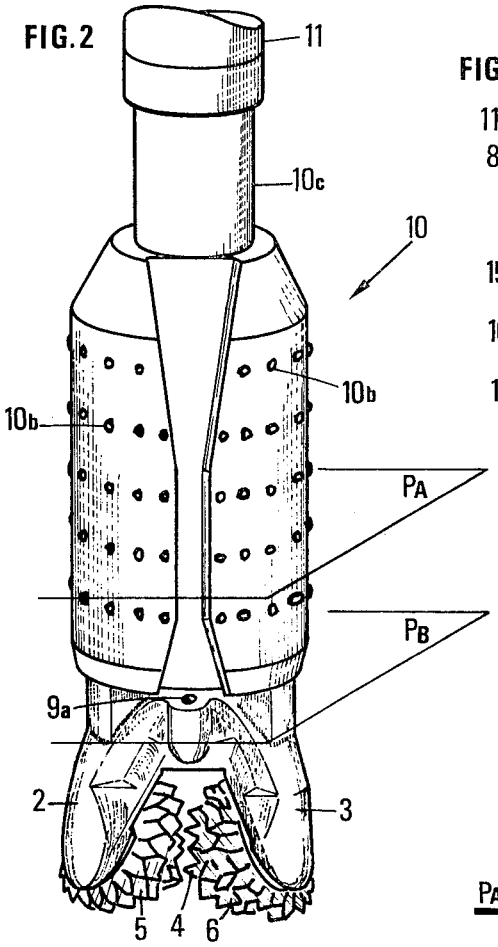
FIG.1
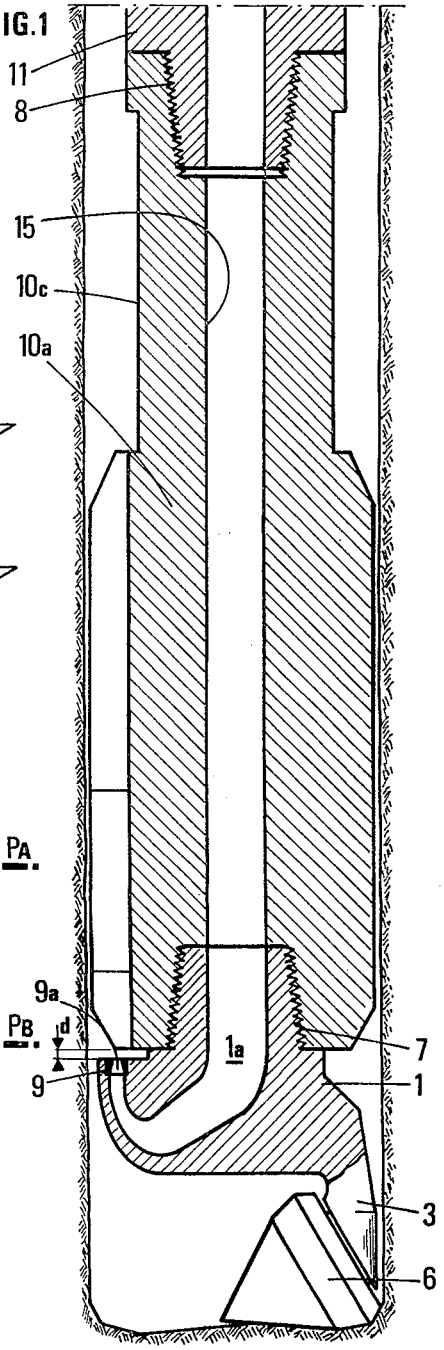
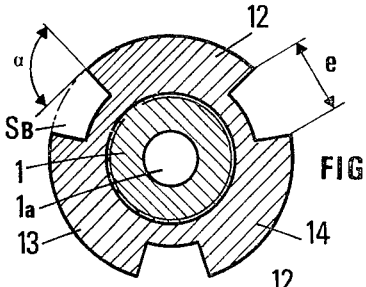
FIG.2B
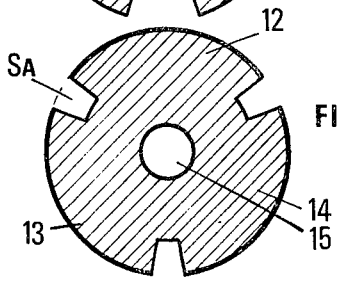
FIG.2A

BLADE STABILIZER PROVIDED WITH AT LEAST ONE FLUID PASSAGE HAVING A VENTURI EFFECT, IN PARTICULAR FOR USE IN COMBINATION WITH A DRILL BIT

The present invention relates to a blade stabilizer provided with at least one fluid passage having a Venturi effect, and which is particularly suitable for use with a tool such as a drill bit, as described below by way of non limitative example. This stabilizer is adapted to be secured above the drill bit, coaxially with the drill string, so as to keep a selected drilling direction. It preferably comprises two radial blades or wings forming there between free angular spaces for the upward flow of drill cuttings towards the borehole opening.

More specially, the stabilizer according to the invention associates to a stabilizing action on the drill bit position a reinforcing effect on the eduction of drill cuttings, when used in combination with a drill bit comprising a body member provided with ground cutting elements and comprising, outside the tool body and recessed with respect to said ground cutting elements, at least one eduction nozzle creating at least one jet of drilling fluid in a direction opposite to the direction of advance of the drill bit.

The stabilizer according to the invention is provided with blades whose width increases over at least a first portion of their height starting from the lower edge of these blades, so that the ratio of the greatest to the smallest cross sections of the free passage between said first portions of two consecutive blades is at most equal to 7.5. Optionally, said first portion of the blades is extended by a portion of substantially constant width and/or by a portion of decreasing width.

When combined with a drill bit of the above-defined type, the stabilizer according to the invention will be so positioned that each eduction nozzle of the bit opens in the interval between two consecutive blades and is preferably oriented along the axis of this free space.

Figure 3:
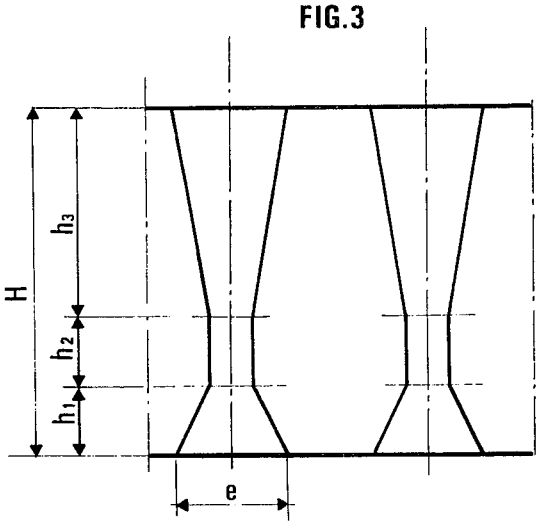
Figure 4:
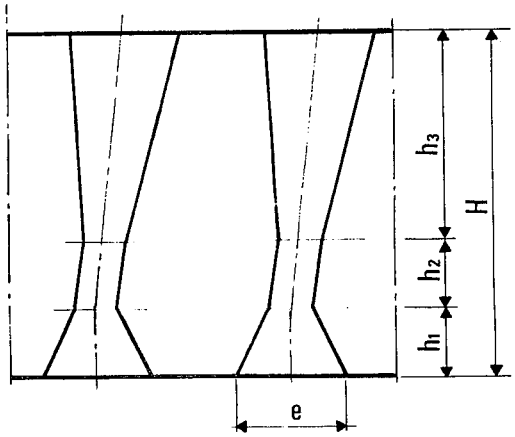

Embodiments of the present invention are illustrated in the accompanying drawings wherein:

FIG. 1 is an axial cross section of a drill bit to which the invention may be adapted, FIG. 2 illustrates an embodiment of a stabilizer according to the invention, FIGS. 2A and 2B show sections of the stabilizer of FIG. 2 by planes $P_A$ and $P_B$ respectively, FIG. 3 is a developed view of the stabilizer illustrated by FIG. 2, FIG. 4 is a developed view of another embodiment of the stabilizer, wherein the blades are inclined to the stabilizer axis, and FIGS. 5, 6, 7A and 7B illustrate further embodiments of the invention.

The drawings illustrate, by way of example, a stabilizer according to the invention, used in combination with a drill bit comprising a body 1 provided with three arms, such as arms 2 and 3 (FIG. 2) carrying ground cutting elements constituted, for example, by three conical rollers, such as rollers 5 and 6, rotatably mounted on roller bearings (not shown) and whose axes are at an angle to the bit axis. Each of these rollers may be of any known type and be provided with teeth 4, as shown in FIG. 2, or with other ground cutting elements capable of attacking the ground formations at the level of the hole bottom. The body 1 of the drill bit is threaded at its upper part 7 to permit connection of the bit to a stabilizer designated as a whole by reference numeral 10, this stabilizer being itself secured, as by a threading 8, to the lower end of a bit holder which drives it in rotation.

This bit holder may consist of a drill string 11 in the case of the rotary drilling process. When the drill bit is directly rotated by a downhole motor, the bit holder, may be constituted by the rotor of this motor.

In the bit body 1 a recess **1*a* communicates with the inner bore of the drill string 11 through a central bore 15** of the stabilizer.

The bit body 1 is provided with at least one suction nozzle, such as 9 having at least one calibrated aperture such as **9*a*. This nozzle is adapted to create at least one jet of drilling fluid (FIG. 1) in a direction opposite to the direction of advance of the bit into the ground. In the drawings the aperture 9*a*** is of circular shape but it could also have the general shape of a slot or be replaced by several circular angularly spaced apertures.

The stabilizer 10 is located between the drill bit and drill string 11, having the same axis as the latter, to maintain the drill bit in the selected drilling direction.

At its lower part **10*a*, the outer diameter of the stabilizer is substantially the same as the diameter of the drilled well. As well known in the art, the external surface of the stabilizer will preferably be provided with ground cutting elements 10*b* (FIG. 2). At its upper part 10*c***, the outer diameter of the stabilizer will be substantially smaller than the diameter of the borehole, this upper part being adapted to receive an overshot or fishing tool.

At its lower part **10*a*, stabilizer 10 comprises, for example, three radial blades or wings 12, 13, 14** delimiting free intervals or angular spaces for the upward flow of the drilling fluid. The profile of these blades is such that these angular spaces are shaped as Venturi ducts.

In the illustrated embodiment the width of these blades increases over a first portion thereof having a height H, when starting from the lower edge of these blades, then this width is substantially constant over a second portion of the blades, just above the first portion thereof, and thereafter the blade width decreases over a third portion of the blade height, above said second portion.

In FIG. 3, for example, references $h_1$, $h_2$ and $h_3$ designate respectively the heights of said first, second and third portions of the blades, measured parallelly to the stabilizer axis.

$S_B$ (FIG. 2B) being the cross-sectional area of the free space between two consecutive blades, measured at the level of their bottom i.e. at the level of plane $P_B$ (FIGS. 1 and 2), and $S_A$ being (FIG. 2A) the cross-sectional area of the free space between two consecutive blades, measured at a level where the blades are of a substantially constant width, such as at the level of plane $P_A$ (in other words, $S_B$ and $S_A$ being respectively the greatest and the smallest cross-sections of the convergent first portion of the free space between consecutive blades, above the drill bit), it has been ascertained that a good efficiency of the device is reached when the value of the ratio $S_B/S_A$ is at least equal to 1.5 and does not exceed 7.5. It has been furthermore ascertained that the height $h_1$ of the first blade portion along which the blade width decreases, must be at least equal to half the distance "e" (FIGS. 2B, 3 and 4) between the lower edges of consecutive blades, i.e. the distance between two blades measured at the level of plane $P_B$ (FIGS. 1 and 2).

As apparent from the drawings, the profile or configuration of two adjacent blades is indeed such that they define between each other a free space having a Venturi effect, i.e. showing successively in the direction of the upward flow of drill cuttings a convergent first portion, a portion of substantially constant section constituting the neck of the Venturi and, in extension thereof, a third divergent portion.

Positioning of stabilizer 10 relative to the drill bit is ensured, for example by threading 7 which connects these two elements, so that each nozzle 9 opens in a free space between two blades, and the lower part of the blades, defined by plane $P_B$ is located above the outlet orifice of nozzle 9 at a distance "d" which is at most equal to 0.3 meter.

In the embodiment illustrated in FIG. 3, the vertical axis of each blade is substantially parallel to the axis of the stabilizer, while in another embodiment (FIG. 4) the axes of these blades are inclined to the stabilizer axis. This inclination, as seen from the lower part of the blades will preferably be such as to correspond to a winding pitch which is opposite to the direction of rotation of the drill bit.

Tests have shown that this inclination substantially enhances the flow of flushing fluid loaded with drill cuttings through the free spaces between the blades.

Changes may be made without departing from the scope of the present invention. For example the number of blades will be so selected by the specialist as to permanently provide for a correct bit centering and to obtain the required fluid flow rate through the free spaces between the blades.

In the embodiment illustrated by FIGS. 1 to 3, in which the axes of the blades are parallel to the device axis, and wherein this device is used in combination with a drill bit, the use of three radial blades seems appropriate to ensure a correct centering as well as a suitable fluid flow rate, while dynamic balancing of the assembly can be easily achieved.

Figure 5:
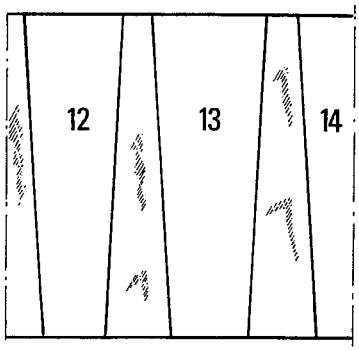
Figure 6:
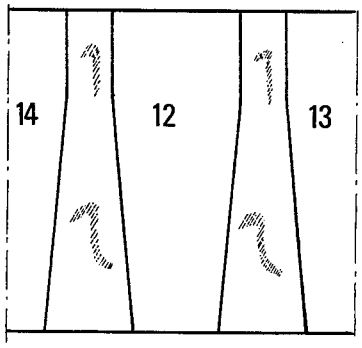

In simplified embodiments shown in FIGS. 5 and 6 the blade profile can be such that two consecutive blades define free spaces which are convergent over their whole length when moving upwardly from the drill bit, or alternatively free spaces having a convergent portion surmounted by a portion of substantially constant cross-section.

The shape of the cross section of the free angular spaces may be selected by the specialist according to the machining conditions, provided that the wall of each of said free spaces is inclined to the external wall of the stabilizer by an angle $\alpha$ at least equal to 90°.

Figure 7A:
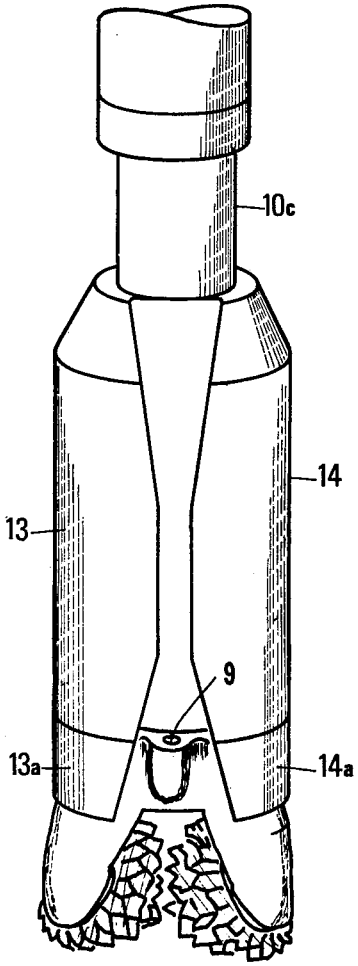
Figure 7B:
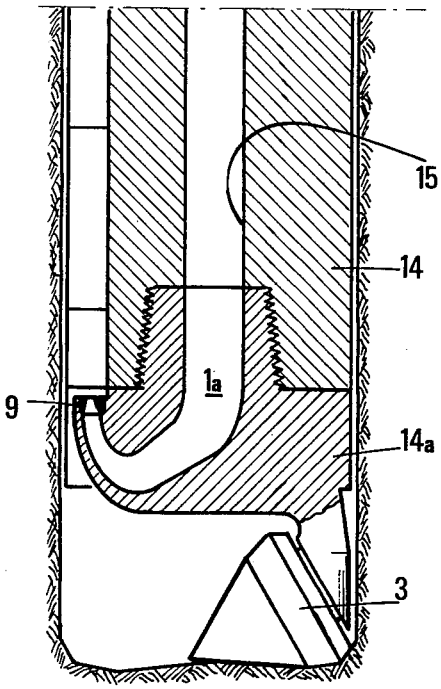

In the embodiment illustrated by FIGS. 7A and 7B the number of blades of the stabilizer is equal to the number of radial arms of the drill bit. In the extension of blades 12, 13 and 14 are located elements 12*a*, 13*a* and 14*a* respectively each of which is integral with one arm of the bit, these elements being either set-in or cast in one piece with the drill bit. The lower edge of the blades is then at a lower level than the orifice of nozzle 9.

It would be obviously possible, without departing from the scope of the present invention, to build in only one piece the assembly of the drill bit and of the stabilizer.

What we claim is:

1. A stabilizer for a drill bit secured at the lower end of a drill string, said stabilizer being adapted to be positioned between said drill bit and said drill string, coaxially therewith, so as to maintain selected drilling direction, said stabilizer comprising a central hollow section and at least two radially shaped blades defining between each other at least one Venturi-shaped free angular space for a flow of drilling fluid, the width of each of said at least two blades increasing over at least a first portion of the height of each of said blades from the end of each of said blades near said drill bit, the height of said at least first portion being at least equal to one half of the width of the lower end of said at least one free angular space defined by the lower edges of two adjacent blades.

2. A stabilizer according to claim 1, wherein the width of each of said at least two blades is substantially constant over a second portion of the height of each of said blades above said first portion of each of said blades.

3. A stabilizer according to claim 1, wherein the width of each of said at least two blades decreases along a third portion of the height of each of said blades above said second portion of the height of each of said blades.

4. A stabilizer according to claim 1, wherein said at least two blades are inclined with respect to the axis of the stabilizer.

5. A stabilizer according to claim 1, wherein each of said at least two blades is parallel to the axis of the stabilizer.

6. A stabilizer according to claim 1, wherein outer surface of each of said at least two radially spaced blades comprises ground cutting elements.

7. A stabilizer according to claim 1, wherein the ratio of the greatest to the smallest cross-section of said angular free space, measured on said first portion of the height of each of said blades is equal to or less than 7.5.

8. A stabilizer according to claim 7, wherein said ratio is at least equal to 1.5.

9. A stabilizer according to claim 1, comprising at its periphery at least one eduction nozzle means for the upward flow of ground cuttings, and at least three radially shaped blades defining between each other at least one free angular space for the upward flow of ground cuttings towards the borehole opening, at least two of said at least three radially spaced blades being adjacent to each other, said at least two adjacent blades having said configuration defining said angular free space forming said Venturi, the axis of said free angular space between said at least two adjacent blades being substantially aligned with said eduction nozzle means, the height of a convergent portion of said Venturi being at least equal to one half of the width of the lower end of said at least one free angular space defined by the lower edges of said at least two adjacent blades.

10. A stabilizer according to claim 9, wherein the bottom of said at least three blades is spaced by not more than 0.3 meter from said eduction nozzle means.

11. A stabilizer according to claim 9, wherein said Venturi-type space is inclined on the bit axis with a winding pitch opposite to the direction of rotation of said drill bit.

12. A stabilizer according to claim 9, wherein said at least three blades substantially contact the drill bit at their lower part so that the bottom of said angular free space forming a Venturi is at a lower level than said eduction nozzle means.

13. A stabilizer according to claim 9, wherein the ratio of the greatest to the smallest cross section of said convergent portion of said free angular space is equal to or less than 7.5.

14. A stabilizer according to claim 13, wherein said ratio is equal to at least 1.5.

* * * * *

UNITED STATES PATENT AND TRADEMARK OFFICE

CERTIFICATE OF CORRECTION

PATENT NO. : 4,245,708

DATED : January 20, 1981

INVENTOR(S) : Henri Cholet et al

It is certified that error appears in the above—identified patent and that said Letters Patent is hereby corrected as shown below:

Column 1, line 43: reads "FIG. 1 is an axial cross section of a drill bit to which"

Should read -- FIG. 1 is an axial cross section of a stabilizer and drill bit to which -- .

Column 2, line 63: reads "decreases, must be at least equal to half the distance "e" "

Should read -- increases, must be at least equal to half the distance "e" -- .

Signed and Sealed this

*Twenty-first* Day of *April 1981*

[SEAL]

*Attest:*

RENE D. TEGTMEYER

*Attesting Officer*

*Acting Commissioner of Patents and Trademarks*